US012349823B2

(12) United States Patent
Hamn et al.

(10) Patent No.: US 12,349,823 B2
(45) Date of Patent: Jul. 8, 2025

(54) CHRISTMAS TREE SKIRT DEVICE

(71) Applicants: Vonda Hamn, Fredericksburg, VA (US); Howard Hamn, Fredericksburg, VA (US)

(72) Inventors: Vonda Hamn, Fredericksburg, VA (US); Howard Hamn, Fredericksburg, VA (US)

( * ) Notice: Subject to any disclaimer, the term of this patent is extended or adjusted under 35 U.S.C. 154(b) by 0 days.

(21) Appl. No.: 18/185,842

(22) Filed: Mar. 17, 2023

(65) Prior Publication Data

US 2023/0301453 A1 Sep. 28, 2023

Related U.S. Application Data

(60) Provisional application No. 63/322,849, filed on Mar. 23, 2022.

(51) Int. Cl.
*A47G 33/04* (2006.01)
*A47G 33/08* (2006.01)

(52) U.S. Cl.
CPC ..... *A47G 33/045* (2013.01); *A47G 33/08* (2013.01); *A47G 2033/0827* (2013.01)

(58) Field of Classification Search
CPC ..... A47G 33/045; A47G 33/08; A47G 2033/0827
See application file for complete search history.

(56) References Cited

U.S. PATENT DOCUMENTS

| | | | | |
|---|---|---|---|---|
| 4,581,277 | A * | 4/1986 | Neale | A47G 33/045 2/919 |
| 5,593,743 | A | 1/1997 | Baker | |
| 10,213,039 | B2 | 2/2019 | Henz | |
| 2003/0200589 | A1 | 10/2003 | Therres | |
| 2005/0166448 | A1 | 8/2005 | Liu | |
| 2013/0235563 | A1 | 9/2013 | Roos | |
| 2014/0260107 | A1* | 9/2014 | Conti | B65D 65/00 53/461 |
| 2018/0078071 | A1* | 3/2018 | Olds | A47G 33/045 |

* cited by examiner

*Primary Examiner* — Kim S. Horger
(74) *Attorney, Agent, or Firm* — Brennan, Manna & Diamond, LLC

(57) ABSTRACT

The present invention relates to a novel Christmas tree skirt device. The device comprises a skirt component with a central, continuous opening. Further, the perimeter of the skirt component comprises a weighted perimeter ring. Additionally, weights can also be used along the exterior of the skirt component. The skirt component also comprises a plurality of embedded lights. The skirt component is radially split from the central, continuous opening to the perimeter to allow the skirt component to be placed around a base of a Christmas tree. Further, once in place around the base, hook and loop closures positioned along this split are used to secure the skirt component around the base of the tree. Thus, users apply the skirt component to the base of a Christmas tree to hide extension cords running to the tree, while adding to the overall holiday aesthetic.

11 Claims, 3 Drawing Sheets

CHRISTMAS TREE SKIRT DEVICE

CROSS-REFERENCE TO RELATED APPLICATION

The present application claims priority to, and the benefit of, U.S. Provisional Application No. 63/322,849, which was filed on Mar. 23, 2022, and is incorporated herein by reference in its entirety.

FIELD OF THE INVENTION

The present invention relates generally to the field of Christmas tree skirt devices. More specifically, the present invention relates to an improved Christmas tree skirt device that provides users with a Christmas tree skirt capable of lighting up the base of a tree while hiding unsightly extension cords powering the tree lights. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in Christmas tree skirt devices. Generally, people who put up Christmas trees for the holiday season may do so with several extension cords running to the tree for powering lights. The extension cords look unsightly and often take away from the aesthetic of the tree. Further, people may be unable to properly hide the cords without impacting the look of the tree.

Conventional tree skirts are sometimes unattractive and unappealing. These tree skirts prevent users from matching the décor of the decorated tree. As such, a unique tree skirt which is visually appealing and yet hides unsightly extension cords is needed.

Therefore, there exists a long-felt need in the art for a Christmas tree skirt device that provides users with a Christmas tree skirt capable of lighting up the base of a tree while hiding unsightly extension cords powering the tree lights. There is also a long-felt need in the art for a Christmas tree skirt device that includes weighted materials within the ring and exterior to keep the skirt in place around the tree base. Further, there is a long-felt need in the art for a Christmas tree skirt device that features embedded LED lights to further improve the aesthetic of a Christmas tree. Moreover, there is a long-felt need in the art for a device that offers use as a table setting décor to add a unique flavor to the area during Christmas, Halloween, and other holidays. Further, there is a long-felt need in the art for a Christmas tree skirt device that includes numerous different sizes and styles to accommodate any type of Christmas tree. Finally, there is a long-felt need in the art for a Christmas tree skirt device that is decorative and effective at hiding unsightly extension cords from a Christmas tree.

The subject matter disclosed and claimed herein, in one embodiment thereof, comprises a Christmas tree skirt device. The device is a decorative accessory for Christmas trees and tabletops. The device comprises a skirt component with a central, continuous opening. Further, the perimeter of the skirt component comprises a weighted perimeter ring. Additionally, weights can also be used along the exterior of the skirt component. The skirt component also comprises a plurality of embedded lights which are powered by concealed wires and a battery pack. The skirt component is radially split from the central, continuous opening to the perimeter to allow the skirt component to be placed around a base of a Christmas tree. Further, once in place around the base, hook and loop closures positioned along the radial split are used to secure the skirt component around the base of the tree. Thus, users apply the skirt component to the base of a Christmas tree to hide extension cords running to the tree while adding to the overall holiday aesthetic.

In this manner, the Christmas tree skirt device of the present invention accomplishes all of the foregoing objectives and provides users with a device that effectively hides unsightly extension cords from a Christmas tree. The device is a decorative accessory for Christmas trees and tabletops. The device fits most standard Christmas trees and can be manufactured in multiple designs and styles based on a user's preferences.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a Christmas tree skirt device. The device is a decorative accessory for Christmas trees and tabletops. The device comprises a skirt component with a central, continuous opening and a radial split from the central, continuous opening to the perimeter to allow the skirt component to be placed around a base of a Christmas tree and secured. Further, the perimeter of the skirt component comprises a weighted perimeter ring. Additionally, weights can also be used along the exterior of the skirt component. The skirt component also comprises a plurality of embedded lights. In use, users apply the skirt component to the base of a Christmas tree to hide extension cords running to the tree while adding to the overall holiday aesthetic.

Broadly, an embodiment of the present invention provides a lighted Christmas tree skirt device that can be formed in various shapes, styles, and sizes and can include attached lights. The tree skirt device can complete and finish the Christmas tree decoration process down to the floor with decorations and lights. The decorations on the tree skirt device can be chosen to match the decorations used for the tree. Additionally, the lights of the tree skirt device can be chosen to match the lights used for the tree. Typically, the lights are embedded throughout the exterior of the tree skirt or wrapped around an outer perimeter of the tree skirt.

In one embodiment, the Christmas tree skirt device is designed to be placed around the base of a Christmas tree. The tree skirt device can include a skirt component comprising a central, continuous opening. Further, the skirt component is radially split from the central, continuous opening to the perimeter to allow the skirt component to be placed around the base of a Christmas tree. The radial split is cut through to form a first end and a second end of the skirt component. The skirt component also comprises a base fabric which can be formed of various materials and can include various designs and colors. In some embodiments, the base fabric is a felt material. Additional decorations and accessories can be attached around an exterior of the skirt component.

In one embodiment, a means is provided to releasably connect the opposite, longitudinal ends (i.e., the first end and the second end) of the skirt component together. Typically, the connecting means is a conventional two-component Velcro type fastener. One component, the loop member is attached by sewing, gluing or the like to one longitudinal end (i.e., the first end) and the other component, the hook member is attached to the opposite longitudinal edge (i.e., the second end) via the same attachment means. Accordingly, when the skirt component is spread circularly around the base of the Christmas tree, the opposite ends of the skirt component are brought together and secured. Specifically, the resulting meeting radial edges are secured releasably together by engagement of the cooperating Velcro fastener components.

In operation, the Christmas tree skirt of the present invention is positioned about a conventional Christmas tree base. Specifically, the skirt component is fanned circularly about the base, such that the inner side edge of the skirt component encircles the base completely, while the outer edge forms an enlarged circle completely surrounding and hiding the legs of the Christmas tree stand. The meeting radial edges of the skirt component are then brought together and secured to one another by engagement of the cooperating Velcro fastener components. The resulting tree skirt formed is conical in configuration, and entirely hides the unsightly conventional Christmas tree stand from view.

In another embodiment, the skirt component comprises a weighted perimeter ring around the perimeter of the skirt component. Additionally, a plurality of weights can also be used along the exterior of the skirt component. In use, users can elect to only have the perimeter ring weighted, the exterior of the skirt component weighted, or both. The weights help the Christmas tree skirt device to remain in place under the tree. Any suitable number of weights can be utilized as is known in the art, and the weights can be any suitable shape and size as is known in the art, depending on the needs and/or wants of a user. In one embodiment, the weights are removable and are inserted into small pockets located on the underside of the skirt component, as needed. In another embodiment, the weights are not removable and are sewn into the underside of the skirt component.

In one embodiment, the tree skirt device can include a plurality of embedded lights. The plurality of lights are embedded throughout the exterior of the skirt component. The embedded lights can be wired together and can include an electric plug for powering the lights. In some embodiments, the embedded lights can be powered without the need for the electric plug, such as by batteries or a battery pack, for example. Typically, the wires of the embedded lights are concealed underneath the skirt component, allowing for a greater aesthetic appeal. The lights can be designed in various styles and colors. For example, the lights can be solid, flash, blink, fade, etc. The lights can be all the same color or can be designed with different colors. In some embodiments, the lights can be miniature lights, light emitting diodes (LEDs), etc. In some embodiments, the lights can include a shape, such as a holiday design, a sports mascot, animals, various themes, etc. The embedded lights can be disposed about the outer perimeter of the skirt component, as well as the exterior of the skirt component.

In another embodiment, the skirt component includes a bottom layer and an upper layer with the plurality of decorative lights embedded therebetween. The embedded lights can be connected to wires which are secured to the bottom layer of the skirt component. Further, the bottom layer of the skirt component can also include a battery pack for powering the embedded lights. The connection between the two layers of the skirt component can be completed by any desired method, such as gluing, adhesives, sewing, etc. Furthermore, the upper layer of the skirt component is provided with a plurality of openings which allow the embedded lights to be exposed from the openings.

In another embodiment, the tree skirt device can include additional decorations, such as garland, tinsel, bows, wreaths, etc., which are disposed about the embedded lights. The decorations can be in various colors, styles, and designs and typically can be the same style and color as that used on the Christmas tree to provide a continuous and complete decoration of the Christmas tree all the way to the floor.

While the Figures show a round Christmas tree skirt device, the tree skirt device of the present invention can be designed in various shapes, including geometric and non-geometric shapes. The base fabric can be made in various shapes as well as decorative ruffles. The lights and decorations can also be laid out in various shapes, typically matching the shape of the skirt component, but, in some embodiments, the lights and decorations may be laid out in shapes different from the skirt component.

While the description above discusses a tree skirt for Christmas trees, the tree skirt device of the present invention can be used to dress various items, including other trees or items having a mounting post or stand, around which one desires to add decoration. In still other embodiments, the tree skirt device can be used for other applications, such as being draped around a person or some other object. In some embodiments, the tree skirt device of the present invention can be sized and shaped (such as an elongated rectangular shape) as a table runner or a decorative table topper.

The material of the skirt component may, as discussed earlier, be manufactured of paper, plastic, or fabric sheet material, but preferably of a weight that will allow the tree skirt to be properly placed around a Christmas tree base without sagging or otherwise losing its structural integrity. Also, the material may include ornamental designs and decorations befitting the season to further enhance the appearance of the tree skirt in use. Further, the inner and outer edges may also include additional decorative material, such as fabric, ribbons, lace, or other desirable material in order to further enhance the appearance of the tree skirt and also to prevent tearing and fraying which may result from repeated use.

In yet another embodiment, the Christmas tree skirt device comprises a plurality of indicia.

In yet another embodiment, a method of hiding unsightly extension cords from Christmas trees is disclosed. The method includes the steps of providing a Christmas tree skirt device comprising a skirt component with a central, continuous opening and a weighted perimeter ring, as well as a plurality of lights and additional weights positioned along the exterior of the skirt component. The method also comprises choosing a specific style and size of the Christmas tree skirt device, depending on the needs and/or wants of a user. Further, the method comprises opening the radial split and positioning the Christmas tree skirt device around a base of a Christmas tree. Finally, the method comprises securing the Christmas tree skirt device around the tree base via the hook and loop enclosures to hide the unsightly extension cords running from the tree.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1B:
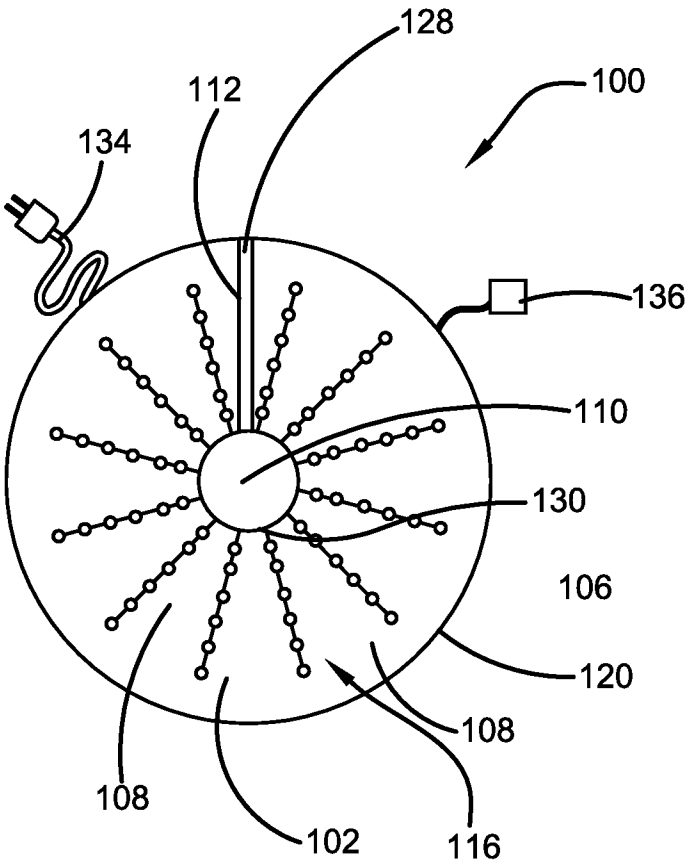
FIGS. 1A-B illustrate a top perspective view of one embodiment of the Christmas tree skirt device of the present invention showing the weighted perimeter and radial split in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a Christmas tree skirt device that provides users with a Christmas tree skirt capable of lighting up the base of a tree while hiding unsightly extension cords powering the tree lights. There is also a long-felt need in the art for a Christmas tree skirt device that includes weighted materials within the ring and exterior to keep the skirt in place around the tree base. Further, there is a long-felt need in the art for a Christmas tree skirt device that features embedded LED lights to further improve the aesthetic of a Christmas tree. Moreover, there is a long-felt need in the art for a device that offers use as table setting décor to add a unique flavor to the area during Christmas, Halloween, and other holidays. Further, there is a long-felt need in the art for a Christmas tree skirt device that includes numerous different sizes and styles to accommodate any type of Christmas tree. Finally, there is a long-felt need in the art for a Christmas tree skirt device that is decorative and effective at hiding unsightly extension cords from a Christmas tree.

The present invention, in one exemplary embodiment, is a novel Christmas tree skirt device. The device comprises a skirt component with a central, continuous opening. Further, the perimeter of the skirt component comprises a weighted perimeter ring. Additionally, weights can also be used along the exterior of the skirt component. The skirt component also comprises a plurality of embedded lights. The skirt component is radially split from the central, continuous opening to the perimeter to allow the skirt component to be placed around a base of a Christmas tree. Further, once in place around the base, hook and loop closures positioned along this split are used to secure the skirt component around the base of the tree. The present invention also includes a novel method of hiding unsightly extension cords from Christmas trees. The method includes the steps of providing a Christmas tree skirt device comprising a skirt component with a central, continuous opening and a weighted perimeter ring, as well as a plurality of lights and additional weights positioned along the exterior of the skirt component. The method also comprises choosing a specific style and size of the Christmas tree skirt device, depending on the needs and/or wants of a user. Further, the method comprises opening the radial split and positioning the Christmas tree skirt device around a base of a Christmas tree. Finally, the method comprises securing the Christmas tree skirt device around the tree base via the hook and loop enclosures to hide the unsightly extension cords running from the tree.

Figure 1A:
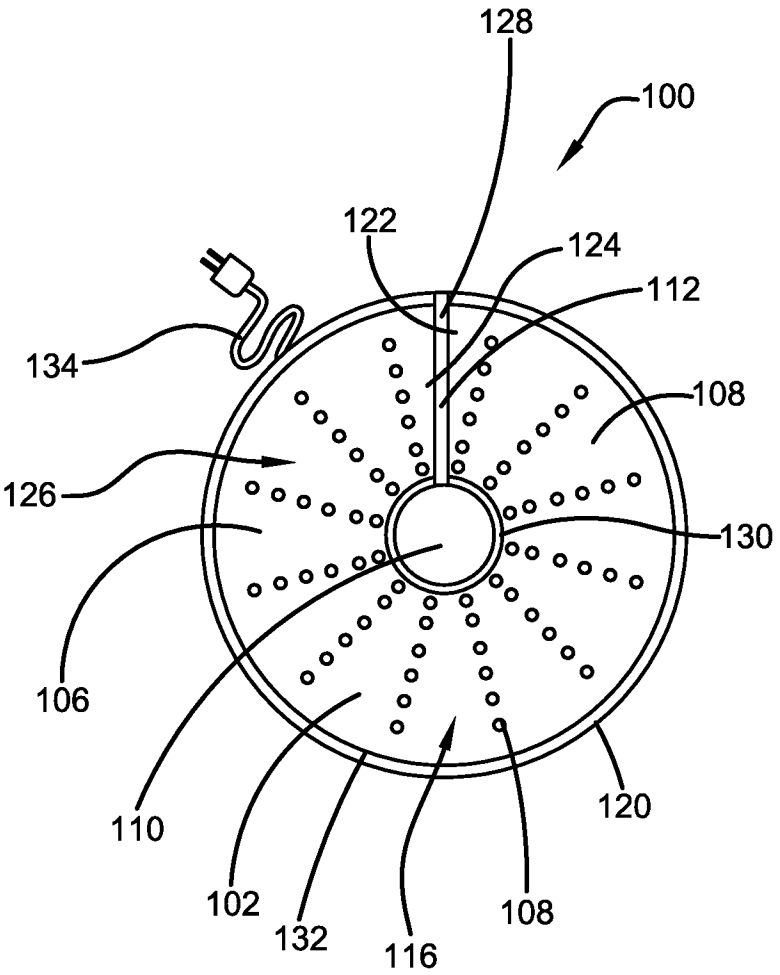

Referring initially to the drawings, FIGS. 1A-B illustrate a perspective view of one embodiment of the Christmas tree skirt device 100 of the present invention. In the present embodiment, the Christmas tree skirt device 100 is an improved tree skirt device 100 that is effective at hiding unsightly extension cords while still improving the aesthetic appeal of the Christmas tree 104. Further, the device 100 is a decorative accessory for Christmas trees 104 and tabletops. Specifically, the device 100 comprises a skirt component 102 with a plurality of weights 106 and embedded lights 108. Furthermore, the device 100 comprises a skirt component 102 with an opening 110 and a radial split 112 to allow the skirt component 102 to be placed around a base 114 of a Christmas tree 104 and secured. In use, users apply the skirt component 102 to the base 114 of a Christmas tree 104 to hide extension cords running to the tree 104, while adding to the overall holiday aesthetic.

Broadly, an embodiment of the present invention provides a lighted Christmas tree skirt device 100 that can be formed in various shapes, styles, and sizes and can include attached lights 108. The tree skirt device 100 can complete and finish the Christmas tree decoration process down to the floor with decorations and lights. The decorations 118 on the tree skirt device 100 can be chosen to match that used for the tree 104. Additionally, the lights 108 of the tree skirt device 100 can be chosen to match the lights used for the tree 104. Typically, the lights 108 are embedded throughout the exterior 116 of the skirt component 102, or wrapped around an outer perimeter 120 of the skirt component 102.

Generally, the Christmas tree skirt device 100 is designed to be placed around the base 114 of a Christmas tree 104. The tree skirt device 100 can include a skirt component 102 comprising a central, continuous opening 110. Further, the skirt component 102 is radially split from the central, continuous opening 110 to the outer perimeter 120 to allow the skirt component 102 to be placed around the base 114 of a Christmas tree 104. The radial split 112 is cut through to form a first end 122 and a second end 124 of the skirt component 102. The skirt component 102 also comprises a base fabric 126 which can be formed of various materials and can include various designs and colors. In some embodiments, the base fabric 126 is a felt material. Additional decorations 118 and accessories can be attached about an exterior 116 of the skirt component 102.

Further, a means is provided to releasably connect the opposite, longitudinal ends (i.e., the first end 122 and the second end 124) of the skirt component 102 together. Typically, the connecting means is a conventional two-component Velcro type fastener 128. One component, the loop member, is attached by sewing, gluing or the like to one longitudinal end (i.e., the first end 122) and the other component, the hook member is attached to the opposite longitudinal edge (i.e., the second end 124) via the same attachment means. Accordingly, when the skirt component 102 is spread circularly around the base 114 of the Christmas tree 104, the opposite ends 122 and 124 of the skirt component 102 are brought together and secured. Specifically, the resulting meeting radial edges are secured releasably together by engagement of the cooperating Velcro fastener components 128. Any other suitable fastening means can be utilized as is known in the art as well, such as snaps, zippers, adhesives, etc., depending on the needs and/or wants of a user.

In operation, the Christmas tree skirt device 100 of the present invention is positioned about a conventional Christmas tree base 114. Specifically, the skirt component 102 is fanned circularly about the base 114, such that the inner side edge 130 of the skirt component 102 encircles the base 114 completely, while the outer perimeter edge 120 forms an enlarged circle completely surrounding and hiding the legs of the Christmas tree stand. The meeting radial edges 122 and 124 of the skirt component 102 are then brought together and secured to one another by engagement of the cooperating Velcro fastener components 128. The resulting tree skirt device 100 thus formed is conical in configuration, and entirely hides the unsightly conventional Christmas tree stand from view.

Furthermore, the skirt component 102 comprises a weighted perimeter ring 132 about the outer perimeter 120 of the skirt component 102. Additionally, a plurality of weights 106 can also be used along the exterior 116 of the skirt component 102. In use, users can elect to only have the perimeter ring weighted 132, the exterior 116 of the skirt component 102 weighted, or both. The weights 106 help the Christmas tree skirt device 100 to remain in place under the tree 104. Any suitable number of weights 106 can be utilized as is known in the art, and the weights 106 can be any suitable shape and size as is known in the art, depending on the needs and/or wants of a user. In one embodiment, the weights 106 are removable and are inserted into small pockets located on the underside of the skirt component 102, as needed. In another embodiment, the weights 106 are not removable and are sewn into the underside of the skirt component 102.

Figure 2:
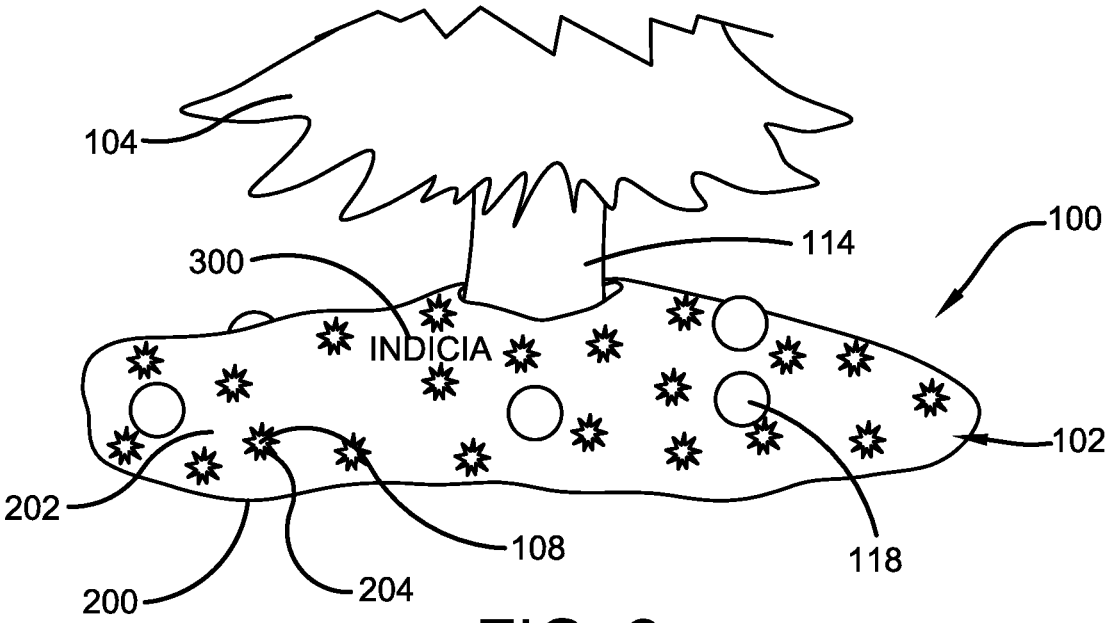
FIG. 2 illustrates a perspective view of one embodiment of the Christmas tree skirt device of the present invention showing the plurality of programmable lights in accordance with the disclosed architecture.

As shown in FIG. 2, the tree skirt device 100 can include a plurality of embedded lights 108. The plurality of lights 108 are embedded throughout the exterior 116 of the skirt component 102. The embedded lights 108 can be wired together and can include an electric plug 134 for powering the lights 108. In some embodiments, the embedded lights 108 can be powered without the need for the electric plug 134, such as by batteries or a battery pack 136, for example, or any other suitable powering means as is known in the art. Typically, the wires of the embedded lights 108 are concealed underneath the skirt component 102 allowing for a greater aesthetic appeal. The lights 108 can be designed in various styles and colors. For example, the lights 108 can be solid, flash, blink, fade, etc. The lights 108 can be all the same color or can be designed with different colors. In some embodiments, the lights 108 can be miniature lights, light emitting diodes (LEDs), etc. In some embodiments, the lights 108 can include a shape, such as a holiday design, a sports mascot, animals, various themes, etc. The embedded lights 108 can be disposed about the outer perimeter 120 of the skirt component 102, as well as the exterior 116 of the skirt component 102.

In one embodiment, the skirt component 102 includes a bottom layer 200 and an upper layer 202 with the plurality of decorative lights 108 embedded therebetween. The embedded lights 108 can be connected to wires which are secured to the bottom layer 200 of the skirt component 102. Further, the bottom layer 200 of the skirt component 102 can also include a battery pack 136 for powering the embedded lights 108. The connection between the two layers 200 and 202 of the skirt component 102 can be completed by any desired method, such as gluing, adhesives, sewing, etc., or any other suitable securing means as is known in the art. Furthermore, the upper layer 202 of the skirt component 102 is provided with a plurality of openings 204 which allow the embedded lights 108 to be exposed from the openings 204.

Figure 3:
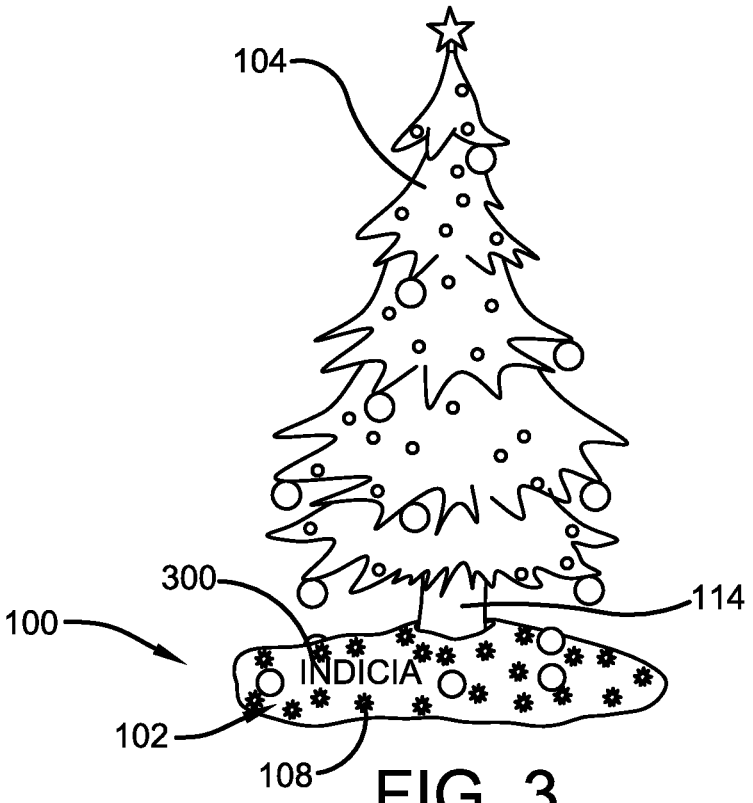
FIG. 3 illustrates a perspective view of one embodiment of the Christmas tree skirt of the present invention in use in accordance with the disclosed architecture.

As shown in FIG. 3, the tree skirt device 100 can include additional decorations 118, such as garland, tinsel, bows, wreaths, etc., which are disposed about the embedded lights 108. The decorations 118 can be in various colors, styles, and designs and typically can be the same style and color as that used on the Christmas tree 104 to provide a continuous and complete decoration of the Christmas tree 104 all the way to the floor.

Furthermore, while the Figures show a round Christmas tree skirt device 100, the tree skirt device 100 of the present invention can be designed in various shapes, including geometric and non-geometric shapes. The base fabric 126 can be made in various shapes as well as decorative ruffles. The lights 108 and decorations 118 can also be laid out in various shapes, typically matching the shape of the skirt component 102, but, in some embodiments, the lights 108 and decorations 118 may be laid out in shapes different from the skirt component 102, depending on the wants and/or needs of a user.

While the description above discusses a tree skirt for Christmas trees 104, the tree skirt device 100 of the present invention can be used to dress various items, including other trees or items having a mounting post or stand around which one desires to add decoration. In still other embodiments, the tree skirt device 100 can be used for other applications, such as being draped around a person or some other object. In some embodiments, the tree skirt device 100 of the present invention can be sized and shaped (such as an elongated rectangular shape) as a table runner or a decorative table topper.

Additionally, the material of the skirt component 102 may, as discussed earlier, be manufactured of paper, plastic, or fabric sheet material, but preferably of a weight that will allow the tree skirt device 100 to be properly placed around a Christmas tree base 114 without sagging or otherwise losing its structural integrity. Also, the material may include ornamental designs and decorations 118 befitting the season to further enhance the appearance of the tree skirt device 100 in use. Further, the inner 130 and outer 120 edges may also include additional decorative material, such as fabric, ribbons, lace, or other desirable material in order to further enhance the appearance of the tree skirt device 100 and also to prevent tearing and fraying which may result from repeated use.

Further, the Christmas tree skirt device 100 comprises a plurality of indicia 300. The skirt component 102 of the device 100 may include advertising, trademark, or other letters, designs, or characters, printed, painted, stamped, or integrated into the skirt component 102, or any other indicia 300 as is known in the art. Specifically, any suitable indicia 300 as is known in the art can be included, such as, but not limited to, patterns, logos, emblems, images, symbols, designs, letters, words, characters, animals, advertisements, brands, etc., that may or may not be Christmas, tree, or brand related.

Figure 4:
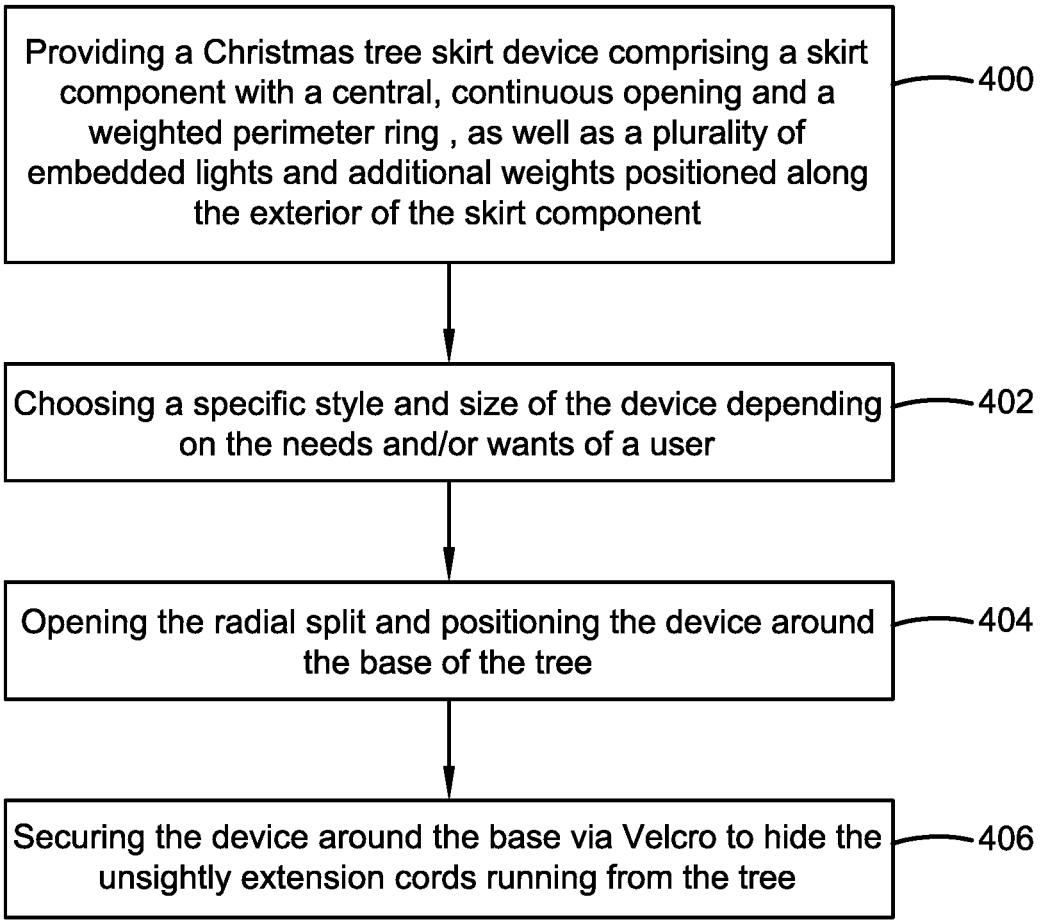
FIG. 4 illustrates a flowchart showing the method of hiding unsightly extension cords from Christmas trees in accordance with the disclosed architecture.

FIG. 4 illustrates a flowchart of the method of hiding unsightly extension cords from Christmas trees. The method includes the steps of at 400, providing a Christmas tree skirt device comprising a skirt component with a central, continuous opening and a weighted perimeter ring, as well as a plurality of lights and additional weights positioned along the exterior of the skirt component. The method also comprises at 402, choosing a specific style and size of the Christmas tree skirt device, depending on the needs and/or wants of a user. Further, the method comprises at 404, opening the radial split and positioning the Christmas tree skirt device around a base of a Christmas tree. Finally, the method comprises at 406, securing the Christmas tree skirt device around the tree base via the hook and loop enclosures to hide the unsightly extension cords running from the tree.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "Christmas tree skirt device", "tree skirt device", "skirt device", and "device" are interchangeable and refer to the Christmas tree skirt device 100 of the present invention.

Notwithstanding the foregoing, the Christmas tree skirt device 100 of the present invention can be of any suitable size and configuration as is known in the art without affecting the overall concept of the invention, provided that it accomplishes the above-stated objectives. One of ordinary skill in the art will appreciate that the Christmas tree skirt device 100 as shown in FIGS. 1-4 are for illustrative purposes only, and that many other sizes and shapes of the Christmas tree skirt device 100 are well within the scope of the present disclosure. Although the dimensions of the Christmas tree skirt device 100 are important design parameters for user convenience, the Christmas tree skirt device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A Christmas tree skirt device that is effective at hiding unsightly extension cords while still improving aesthetic appeal of a Christmas tree, the Christmas tree skirt device comprising:

a skirt component comprising a bottom base fabric layer comprising a plurality of pockets within an underside of the bottom base fabric layer, and an upper fabric layer comprising a plurality of light retaining openings;

a plurality of weights positional within the plurality of pockets; and a plurality of embedded lights, wherein the skirt component has a central continuous opening to allow the skirt component to be placed around a base of the Christmas tree and secured thereto; and wherein the plurality of embedded lights are embedded between the bottom base fabric layer and the upper fabric layer and are exposed through the plurality of light retaining openings;

wherein the skirt component is radially split from the central, continuous opening to an outer perimeter forming a first end and a second end releasably secured together via a zipper to allow the skirt component to be placed around the base of the Christmas tree;

wherein the skirt component is conical in configuration; and wherein the bottom base fabric layer is sewn to the upper fabric layer.

2. The Christmas tree skirt device of claim 1, wherein the skirt component is fanned circularly about the base, such that an inner side edge of the skirt component encircles the base completely, while the outer perimeter forms an enlarged circle completely surrounding and hiding legs of Christmas tree stand.

3. The Christmas tree skirt device of claim 2, wherein the skirt component comprises a weighted perimeter ring about the outer perimeter of the skirt component.

4. The Christmas tree skirt device of claim 1, wherein the plurality of embedded lights are wired together and include an electric plug for powering the embedded lights.

5. The Christmas tree skirt device of claim 1, wherein the plurality of embedded lights are wired together and include a battery pack for powering the plurality of embedded lights.

6. The Christmas tree skirt device of claim 1, wherein the plurality of embedded lights are LED lights.

7. A Christmas tree skirt device that is effective at hiding unsightly extension cords while still improving aesthetic appeal of a Christmas tree, the Christmas tree skirt device comprising:

a skirt component comprising a central continuous opening and a plurality of pockets within an underside of the skirt component;

a weighted perimeter ring about an outer perimeter of the skirt component;

a plurality of weights positional within the plurality of pockets of the skirt component;

a plurality of embedded LED lights embedded throughout an exterior of the skirt component;

a symbol indicia printed on the exterior of the skirt component; and a tinsel attached to the exterior of the skirt component disposed about the plurality of embedded LED lights; and wherein the skirt component is radially split from the central, continuous opening to an outer perimeter to allow the skirt component to be placed around a base of a Christmas tree;

wherein the radial split is secured with hook and loop fasteners around the base of the Christmas tree;

wherein the plurality of embedded LED lights are wired together and include an electric plug or battery pack for powering the plurality of embedded LED lights; and wherein the skirt component is conical in configuration.

8. The Christmas tree skirt device of claim 7, wherein the Christmas tree skirt device is a decorative table topper.

9. The Christmas tree skirt device of claim 7, wherein the skirt component includes a bottom layer and an upper layer with the plurality of embedded LED lights embedded therebetween.

10. The Christmas tree skirt device of claim 7, wherein the skirt component is fanned circularly about the base, such that an inner side edge of the skirt component encircles the base completely, while the outer perimeter forms an enlarged circle completely surrounding and hiding legs of Christmas tree stand.

11. A method of hiding unsightly extension cords from a Christmas tree, the method comprising the following steps:

providing a Christmas tree skirt device comprising a conical skirt component comprising a base layer comprising a plurality of pockets within an underside of the base layer, an upper layer adhesively attached to the base layer, a central continuous opening, a weighted perimeter ring, a plurality of embedded lights, a plurality of additional weights removably positional within the plurality of pockets, and at least one symbol indicia integrated into an exterior of the conical skirt component;

choosing a specific style and size of the Christmas tree skirt device, depending on the needs of a user;

opening the radial split and positioning the Christmas tree skirt device around a base of the Christmas tree; and securing the Christmas tree skirt device around the base of the Christmas tree via a plurality of snap fasteners to hide the unsightly extension cords running from the Christmas tree.

* * * * *